US008008999B2

(12) United States Patent
Morimura

(10) Patent No.: US 8,008,999 B2
(45) Date of Patent: Aug. 30, 2011

(54) ELECTROMAGNETIC RELAY

(75) Inventor: Masato Morimura, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 204 days.

(21) Appl. No.: 12/540,723

(22) Filed: Aug. 13, 2009

(65) Prior Publication Data

US 2010/0039195 A1 Feb. 18, 2010

(30) Foreign Application Priority Data

Aug. 15, 2008 (JP) ..... 2008-209264

(51) Int. Cl.
*H01H 51/22* (2006.01)
*H01H 67/02* (2006.01)

(52) U.S. Cl. ..... 335/78; 335/80; 335/129

(58) Field of Classification Search ..... 335/78, 335/80, 129, 130, 189
See application file for complete search history.

(56) References Cited

U.S. PATENT DOCUMENTS 4,025,884 A * 5/1977 Wright et al. ..... 335/129
4,701,734 A * 10/1987 Nakano et al. ..... 335/128
4,956,623 A * 9/1990 Kimpel Rolf-Dieter ..... 335/128
5,554,962 A * 9/1996 Perreira et al. ..... 335/78
5,617,067 A * 4/1997 Arora et al. ..... 335/78
5,886,601 A * 3/1999 Kitamura et al. ..... 335/129
6,320,485 B1 * 11/2001 Gruner ..... 335/78
6,545,575 B1 * 4/2003 Hirabayashi et al. ..... 335/78
7,315,229 B2 * 1/2008 Sasaki et al. ..... 335/78
7,538,646 B2 * 5/2009 Mikl ..... 335/78

FOREIGN PATENT DOCUMENTS

JP 2002-8506 1/2002
JP 2004-172036 6/2004

* cited by examiner

*Primary Examiner* — Elvin G Enad
*Assistant Examiner* — Alexander Talpalatskiy
(74) *Attorney, Agent, or Firm* — Staas & Halsey LLP

(57) ABSTRACT

An electromagnetic relay including an electromagnet, an armature driven by the electromagnet, a movable spring member carrying a movable contact, a fixed member carrying a fixed contact, an actuator arranged between the armature and the movable spring member. The actuator pivots about a pivot axis by an operation of the electromagnet to make the movable contact brought into contact with or separated from the fixed contact. The actuator includes a generally L-shaped body, the pivot axis being defined at a first end of a first arm of the L-shaped body. The armature is attached to the actuator at a second end of a second arm of the L-shaped body opposite to the first end. The movable spring member is engaged with the actuator at a point defined in the second arm of the L-shaped body.

11 Claims, 5 Drawing Sheets

ELECTROMAGNETIC RELAY

BACKGROUND OF THE INVENTION

1. Field of the Invention

The present invention relates to an electromagnetic relay.

2. Description of the Related Art

An electromagnetic relay able to carry a large current supplied from, e.g., a vehicle battery has been known. The electromagnetic relay used for a large current application generally has a configuration able to interrupt the current for emergency purposes.

In order for an electromagnetic relay to be able to carry a large current, the dimensions thereof may have to be increased, because of the requirements of increasing the amount of movement or moving force of the movable contact, ensuring a heat dissipating ability for dissipating large heat generating during the operation of the relay, ensuring the durability of contacts opening or closing during the operation of the relay, etc.

Japanese Unexamined Patent Publication (Kokai) No. 2002-008506 (JP2002-008506A) describes an electromagnetic relay usable for a large current application and able to prevent the dimensions thereof from being increased. The electromagnetic relay of JP2002-008506A includes a twin make-contact configuration, in which a first make-contact pair includes a movable contact and a fixed stationary contact and a second make-contact pair includes a movable contact and a fixed but elastically-displaceable contact.

Japanese Unexamined Patent Publication (Kokai) No. 2004-172036 (JP2004-172036A) also describes an electromagnetic relay usable for a large current application and able to prevent the dimensions thereof from being increased. The electromagnetic relay of JP2004-172036A includes a yoke, a movable contact terminal joined to the yoke by a caulking structure, and a movable contact spring fixed to the movable contact terminal.

SUMMARY OF THE INVENTION

It is desired to provide an electromagnetic relay able to carry and interrupt a large current and also able to prevent the dimensions thereof from being increased.

In one aspect, an electromagnetic relay is provided, which comprises an electromagnet; an armature driven by the electromagnet; a movable spring member movably arranged relative to the electromagnet and carrying a movable contact; a fixed member fixedly arranged relative to the electromagnet and carrying a fixed contact to be opposed to the movable contact; an actuator pivotally arranged relative to the electromagnet and having a pivot axis, the actuator arranged between the armature and the movable spring member and pivoting under an operation of the electromagnet to make the movable contact brought into contact with or separated from the fixed contact; wherein the actuator includes a generally L-shaped body as a cross-sectional shape perpendicular to the pivot axis, the pivot axis being defined at a first end of a first arm of the L-shaped body; wherein the armature is attached to the actuator at a second end of a second arm of the L-shaped body opposite to the first end; and wherein the movable spring member is engaged with the actuator at a point defined in the second arm of the L-shaped body.

According to the above configuration, it is possible to efficiently increase the distance between the pivot axis and the armature, as well as a distance between the pivot axis and the point of engagement with the movable spring member, by using the given dimensions of the actuator to a maximum extent. As the distance between the pivot axis and the armature is increased, it is possible to decrease force required to be generated by the electromagnet and armature to obtain torque required to shift the movable spring member, which contributes to a reduction in dimensions of the electromagnetic relay. As the distance between the pivot axis and the point of engagement with the movable spring member is increased, it is possible to reduce the dimensions and pivoting angle of the armature and actuator, required to shift the movable contact by an amount required to effectively electrically interrupt the movable contact from the fixed contact, which contributes to a reduction in the dimensions of the electromagnetic relay. The above functions or effects are advantageously obtained, in particular, in an electromagnetic relay having relatively large dimensions for a large current application.

The electromagnetic relay may further comprise a permanent magnet associated with the armature; wherein the electromagnet may include a bobbin, a coil wound on the bobbin, an iron core attached to the bobbin and having a first end and a second opposite end, and a yoke having a proximal end connected to the first end of the iron core and a distal end facing the second end of the iron core with a space defined outside the coil between the distal end and the second end; and wherein the armature may include a pair of electrically-conductive plate elements holding the permanent magnet therebetween and respectively connected to poles of the permanent magnet, a part of one of the plate elements being shiftably located in the space between the distal end of the yoke and the second end of the iron core.

The electromagnetic relay may further comprise a base on which the electromagnet, the movable spring member and the fixed member are supported through a press-fit configuration.

BRIEF DESCRIPTION OF THE DRAWINGS

The above and other objects, features and advantages will become more apparent from the following description of preferred embodiments in connection with the accompanying drawings, wherein.

DESCRIPTION OF THE PREFERRED EMBODIMENT

Figure 1:
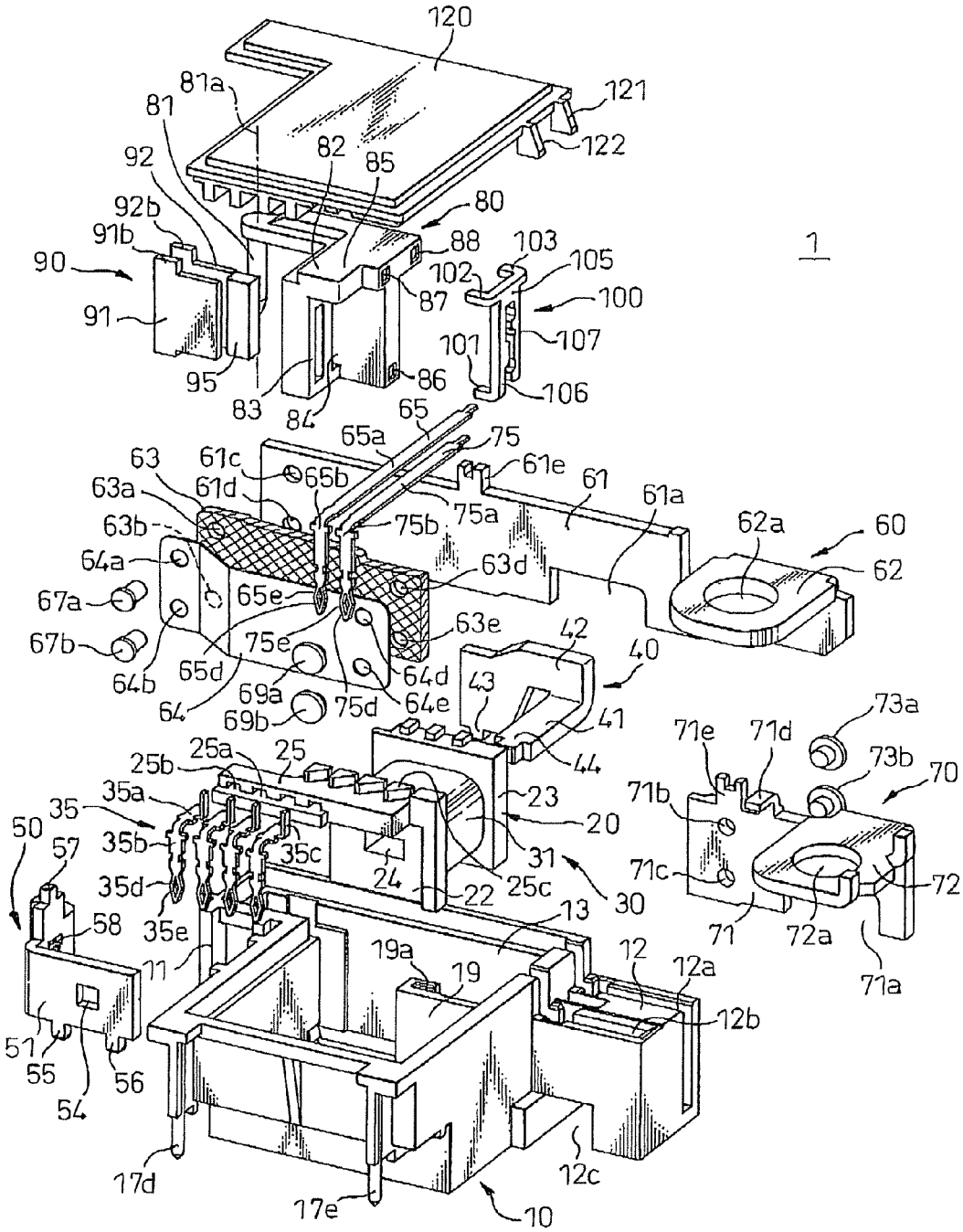
FIG. 1 is an exploded perspective view showing an electromagnetic relay according to an embodiment of the present invention.

The embodiments of the present invention are described below in detail, with reference to the accompanying drawings. In the drawings, the same or similar components are denoted by common reference numerals.

Figure 2:
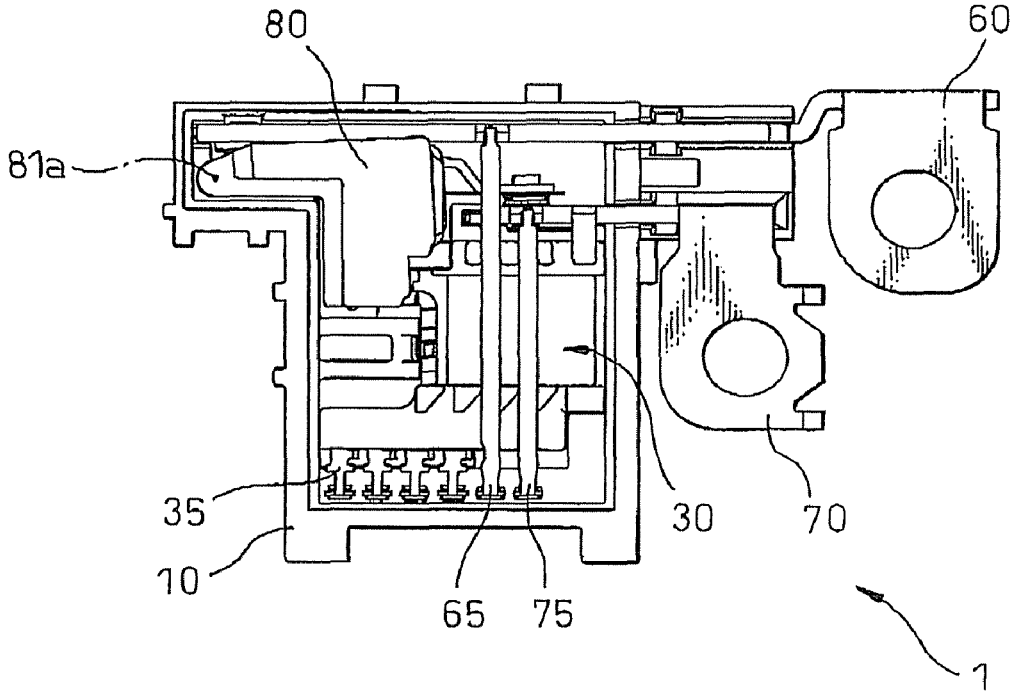
FIG. 2 is a plan view showing the electromagnetic relay of FIG. 1 in an assembled state.
Figure 3:
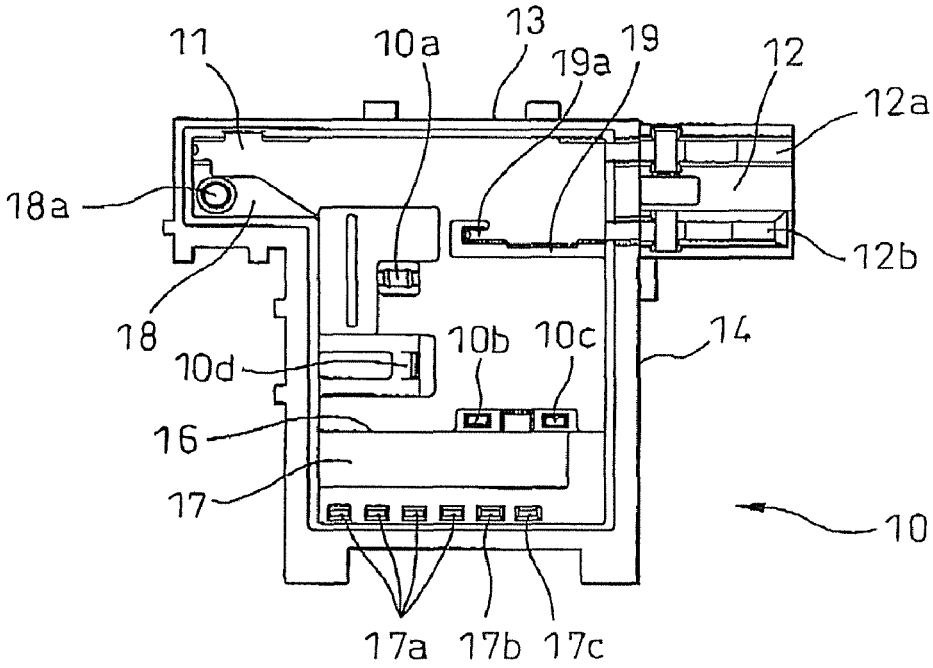
FIG. 3 is a plan view showing a base of the electromagnetic relay of FIG. 1.
Figure 4:
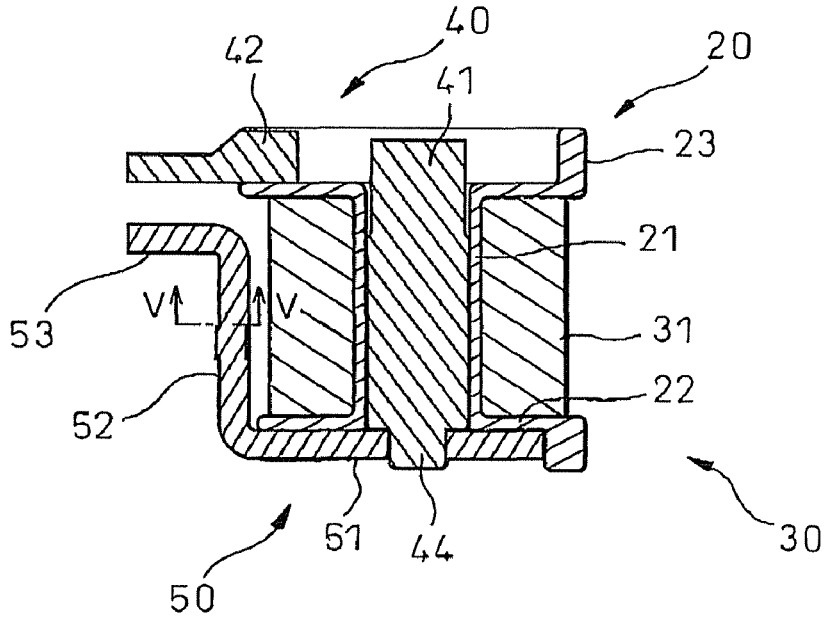
FIG. 4 is a sectional view showing an electromagnet of the electromagnetic relay of FIG. 1.

Referring to the drawings, FIG. 1 schematically shows in an exploded perspective view an electromagnetic relay 1 according to an embodiment of the present invention, FIG. 2 shows in a plan view the electromagnetic relay 1 in an assembled state, FIG. 3 shows in a plan view one component of the electromagnetic relay 1, and FIG. 4 shows in a sectional view another component of the electromagnetic relay 1. In the following explanation, "up" and "down" or other positional relationships are merely used for explaining the illustrated configuration, and an "up" or "down" direction as explained is not necessary to correspond to the direction of gravity.

The electromagnetic relay 1 of the illustrated embodiment is configured as a polarized electromagnetic relay, in which a permanent magnet 95 is assembled, and functions to conduct or interrupt a current flow between a pair of busbar terminal members 60, 70. For example, current supplied from a vehicle battery (not shown) flows between the busbar terminal members 60, 70, and the electromagnetic relay 1 acts to interrupt the supply of current for emergency purposes.

The electromagnetic relay 1 includes a box-shaped base 10 opening upward. The base 10 is made from a molded plastic and has a generally T-shape, as seen in a plan view, including a center rectangular part having an external wall 13 at a backward as seen in FIG. 1 and a left extension 11 and a right extension 12 both laterally extending from the center part along the side of the external wall 13.

The top opening of the base 10 is covered by a molded plastic plate-shaped cover 120. The cover 120 has a generally L-shape, as seen in a plan view, covering the center rectangular part and left extension 11 of the base 10. The cover 120 is provided, at a side corresponding to the right extension 12 of the base 10, with a pair of projections 121, 122 projecting downward, which act to respectively hold down the top edges of plate portions 61, 71 of the busbar terminal members 60, 70 as explained later.

The first busbar terminal member 60 includes a plate portion 61 adapted to extend along the inner surface of the backward external wall 13 of the base 10. The right extension 12 of the base 10 is formed with a groove 12*a* having a width slightly narrower than the thickness of the plate portion 61 of the busbar terminal member 60. The busbar terminal member 60 is pushed into the groove 12*a* so as to be attached to the base 10. Thus, the busbar terminal member 60 is held under the elastic restoring force of base 10 and/or busbar terminal member 60, and thereby is press-fitted in the groove 12*a*. The left end of the plate portion 61 of the busbar terminal member 60 extends to the left end of the left extension 11 of the base 10. As shown in the plan view of the base 10 in FIG. 3, the left extension 11 of the base 10 is provided with an internal wall 18 at which a bearing hole 18*a* is formed for the attachment of an actuator 80 as explained later. Inside the left extension 11 of the base 10, a clearance is formed between the internal wall 18 and the external wall 13, and the left end of the plate portion 61 of the busbar terminal member 60 is securely held in the clearance.

Further, the right extension 12 of the base 10 is provided at the bottom thereof with a recess 12*c* formed outside the base 10 to be adjacent to the right-side external wall 14 of the rectangular part of the base 10. The plate portion 61 of the busbar terminal member 60 is provided with a cutaway 61*a* at a position corresponding to the recess 12*c*. The vertically-extending opposite edges of the cutaway 61*a* are adapted to be abutted respectively to the vertical surface of the groove 12*a* extending along the recess 12*c* and the inner surface of the external wall 14, whereby the busbar terminal member 60 is fixed at a predetermined position in a leftward-rightward direction.

The second busbar terminal member 70 is also attached to the base 10 by press-fitting the plate portion 71 thereof in a groove 12*b* formed in the right extension 12 of the base 10, the groove 12*b* being located in front of the groove 12*a* for the busbar terminal member 60 in FIG. 1. The plate portion 71 of the busbar terminal member 70 is also provided with a cutaway 71*a*. The vertically-extending opposite edges of the cutaway 71*a* are adapted to be abutted respectively to the vertical surface of the groove 12*b* extending along the recess 12*c* and the inner surface of the external wall 14, whereby the busbar terminal member 70 is fixed at a predetermined position in a leftward-rightward direction.

At the right ends of the busbar terminal members 60, 70, connection parts 62, 72 are respectively formed so as to be joined to the plate portions 61, 71 through right-angled bends and thus to horizontally extend. The connection parts 62, 72 may be configured to be suitably connected with, e.g., a power feed line from a vehicle battery. In the illustrated embodiment, circular openings 62*a*, 72*a* are respectively formed in the connection parts 62, 72, which permit the busbar terminal members 60, 70 to be bolted to the power feed line.

The left end of the plate portion 71 of the busbar terminal member 70 extends only to generally the center of the T-shaped base 10. The base 10 is provided inside thereof with an internal wall 19 adapted to extend along the plate portion 71 of the busbar terminal member 70 press-fitted to the groove 12*b*. The internal wall 19 is provided, at the left end thereof located generally at the center of the T-shaped base 10, with a groove 19*a* extending in a vertical direction. The left end of the busbar terminal member 70 is press-fitted in the groove 19*a*.

Near the left end of the plate portion 61 of the busbar terminal member 60, a pair of circular openings 61*c*, 61*d* are formed and arranged to be aligned in a vertical direction. A flat braided wire 63 provided near the left end thereof with similar circular openings 63*a*, 63*b* and a movable spring member 64 provided near the left end thereof with similar circular openings 64*a*, 64*b*, are arranged at the front side of the plate portion 61 of the busbar terminal member 60. The flat braided wire 63 and movable spring member 64 are attached to the busbar terminal member 60 by a pair of rivets 67*a*, 67*b* passed through the openings 61*c*, 61*d*, 63*a*, 63*b*, 64*a* and 64*b*, respectively.

The flat braided wire 63 and the movable spring member 64 are also provided near the right ends thereof with pairs of circular openings 63*d*, 63*e* and 64*d*, 64*e* oppositely to the openings 63*a*, 63*b* and 64*a*, 64*b*, respectively, each pair of openings 63*d*, 63*e* or 64*d*, 64*e* being arranged along a vertical direction. The flat braided wire 63 and the movable spring member 64 are joined to each other at the right ends thereof by a pair of movable contacts 69*a*, 69*b* having rivet-shaped parts passed respectively through the openings 63*d*, 63*e* and 64*d*, 64*e*. Consequently, the flat braided wire 63 is electrically connected in parallel to the movable spring member 64.

The movable contacts 69*a*, 69*b* are disposed at positions facing the left end region of the plate portion 71 of the busbar terminal member 70. On the other band, a pair of fixed contacts 73*a*, 73*b* having rivet-shaped parts are attached to the left end region of the plate portion 71 of the busbar terminal member 70 so as to be opposed respectively to the movable contacts 69*a*, 69*b*, with the rivet-shaped parts of the fixed contacts 73*a*, 73*b* being respectively passed through openings 71*b*, 71*c* formed in the plate portion 71 of the busbar terminal member 70. The movable contacts 69*a*, 69*b* attached to the movable spring member 64 and the fixed contacts 73*a*, 73*b* attached to the plate portion 71 of the busbar terminal member 70 (or a fixed member) are shifted between a state where they are in contact with each other and a state where they are separated from each other, and thereby function to switch the busbar terminal members 60, 70 between a mutually conducting or current-carrying state and a mutually non-conducting or non-current-carrying state, as explained later.

It should be noted that the electromagnetic relay 1 may include the movable spring member 64 movably arranged relative to the electromagnet 30 and carrying at least one movable contact 69*a* (69*b*), and the fixed member (or the busbar terminal member 70) fixedly arranged relative to the electromagnet 30 and carrying at least one fixed contact 73*a* (73*b*) so as to be opposed to the movable contact 69*a* (69*b*).

The base 10 is also provided, on the front side of the rectangular part thereof as seen in FIG. 1, with a shallow bottom area 17 formed adjacent to an internal wall 16 extending vertically to an intermediate height of the base 10 as a boundary of the shallow bottom area 17 and the remaining area of the base 10. Between the mutually opposing internal walls 16, 19, an electromagnet 30 including a molded plastic bobbin 20, a coil 31 wound on the bobbin 20, an iron core 40 attached to the bobbin 20, and a yoke 50 connected to the iron core 40, is press-fitted.

The bobbin 20 includes a hollow tubular part 21 and a pair of flanges 22, 23 formed at the front and back ends of the tubular part 21 as seen in FIG. 1. As shown schematically in FIG. 4 as a horizontal sectional view taken along a plane including the center axis of the electromagnet 30, the coil 31 is wound on the tubular part 21. The flanges 22, 23 have generally rectangular shape, and the bottom edges thereof abut to the bottom inner surface of the base 10, whereby the bobbin 20 is attached to the base 10 in a predetermined posture.

The bobbin 20 is provided with a through hole 24 penetrating through the tubular part 21 and flanges 22, 23. A bar part 41 of the iron core 40 is inserted into the through hole 24 of the bobbin 20. The through hole 24 and the bar part 41 have rectangular cross-sectional shapes corresponding to each other, and thereby the iron core 40 is held in a predetermined posture with respect to the bobbin 20.

The iron core 40 also includes a plate part 42 joined to the bar part 41 at one end thereof at a back side as seen in FIG. 1, the plate part 42 extending parallel to the back-side flange 23 of the bobbin 20. The plate part 42 extends leftward over the flange 23, as seen in FIG. 1 or 4. Near the left end of the plate part 42, a projection 43 is formed on the bottom edge of the plate part 42 so as to be engaged with or received in a recess 10*a* formed in the bottom of the base 10 (FIG. 3). At another end of the bar part 42 of the iron core 40 at a front side as seen in FIG. 1, a projection 44 is formed so as to project from the front-side flange 22 of the bobbin 20.

The yoke 50 includes a proximal-end plate part 51 extending parallel to the front-side flange 22 of the bobbin 20. A generally center opening 54 is formed in the proximal-end plate part 51, and the projection 44 of the bar part 41 of the iron core 40 is securely fitted in the opening 54. The opening 54 and projection 44 have rectangular cross-sectional shapes corresponding to each other, and thereby the yoke 50 is held in a predetermined posture with respect to the iron core 40.

The yoke 50 also includes an intermediate plate part 52 connected to the proximal-end plate part 51 through a backward right-angled bend disposed at the left side in FIG. 1 or 4 of the flange 22, the intermediate plate part 52 extending parallel to the bar part 41 of the iron core 40 received in the tubular part 21 of the bobbin 20. The yoke 50 also includes a distal-end plate part 53 connected to the intermediate plate part 52 through a leftward right-angled bend, the distal-end plate part 53 extending in a direction parallel to the flanges 22, 23 of the bobbin 20.

The distal-end plate part 53 of the yoke 50 faces in parallel the left end portion of the plate part 42 of the iron core 40 with a predetermined space defined therebetween and outside the coil 31 (FIG. 4). Thus, when the coil 31 generates a magnetic field, the magnetic flux is transmitted through the iron core 40 and yoke 50, and a magnetic field is generated between the plate part 42 of the iron core 40 and the distal-end plate part 53 of the yoke 50.

Figure 5:
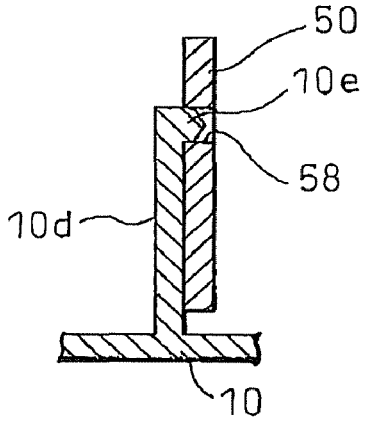
FIG. 5 is a sectional view taken along a line v-v of FIG. 4.

On the bottom edge of the proximal-end plate part 51 of the yoke 50, a pair of projections 55, 56 are formed so as to be engaged with or received in a pair of recesses 10*b*, 10*c* (FIG. 3) formed in the bottom of the base 10, respectively On the top edge of the intermediate plate part 52 of the yoke 50, a projection 57 is formed so as to be engaged with or received in a recess (not shown) formed in the lower side of the cover 120. Further, the intermediate plate part 52 is provided with an opening 58. As shown in FIGS. 3 and 5, the base 10 is provided with an engagement piece 10*d* extending vertically from the bottom of the base 10, and a detent 10*e* is formed on the engagement piece 10*d* at the top end thereof to project toward the yoke 50 of the electromagnet 30. When the electromagnet 30 is press-fitted in the base 10, the detent 10*e* of the engagement piece 10*d* is engaged with or received in the opening 58 of the intermediate plate part 52 of the yoke 50 in a snap-fit manner.

In the illustrated embodiment, the busbar terminal members 60, 70 and electromagnet 30 are configured to be press-fitted to the base 10 by a downward press-fitting operation on the upper side of the base 10, such that the electromagnet 30 is first press-fitted to the base 10 and thereafter the busbar terminal members 60, 70 are press-fitted to the base 10. In this arrangement, the second busbar terminal member 70 is provided with a stopper 71*d* joined to the top edge of the plate portion 71 through a frontward right-angled bend. The stopper 71*d* of the busbar terminal member 70 is engaged with or abutted to the top edge of the back-side flange 23 of the bobbin 20, so as to press down the bobbin 20.

Due to the above configuration, the electromagnet 30, which may be a relatively heavy unit, is stably and firmly held in the base 10. In this connection, a snap-fit structure similar to the combination of engagement piece 10*d* and opening 58 may be provided, additionally or alternatively, in connection with the flanges 22, 23 of the bobbin 20 or the iron core 40 in the electromagnet 30. Further, a snap-fit opening, such as the opening 58 in the illustrated embodiment, may be formed to penetrate through a member, such as the yoke 50 in the illustrated embodiment, in a direction crossing the press-fitting direction at any angle including a right angle in the illustrated embodiment, provided that the electromagnet 30 can be stably held by the snap-fit structure.

Further, according to the configuration wherein the second busbar terminal member 70 is provided with the stopper 70*d*, a retaining force acting on the busbar terminal member 70 by a press-fitting structure relative to the base 10 can also be used to stably hold the electromagnet 30 on the base 10. In particular, for a large current application, the busbar terminal member 70 tends to be relatively large and thus the retaining force acting thereon also tends to be relatively large, so that it is possible to effectively improve the stability of the electromagnet 30 in the base 10.

The electromagnet 30 is provided with four coil terminals 35 respectively connected to the coil 31. The coil 31 is designed to generate a magnetic field in one direction when current flows a first pair of coil terminals 35 and also generate a magnetic field in the opposite direction when current flows a second pair of coil terminals 35.

The bobbin 20 is provided with a terminal holder 25 to which the coil terminals 35 are attached. The terminal holder 25 is formed integrally with, as a unitary member, the front-side flange 22 of the bobbin 20 as seen in FIG. 1, so as to project frontward from the top edge of the flange 22 and extend leftward beyond the side edge of the flange 22. In the substantially left half of the terminal holder 25, a stepped part is provided, and a lower step 25*a* is formed therein. In the vertical wall of the stepped part adjacent the lower step 25*a*, four recesses 25*b* are formed side-by-side at regular intervals in a lateral direction, into which the distal ends of the coil terminals 35 are inserted.

Each coil terminal 35 includes a flat proximal end part 35*a* adapted to extend along the top surface of the low step 25*a* and to be received in the recess 25*b*. The coil terminal 35 also includes a flat distal end part 35*b* joined to the proximal end part 35*a* through a downward right-angled bend. The distal end part 35*b* is adapted to penetrate through a through-hole 17*a* formed in the bottom of the shallow bottom area 17 of the base 10 and project outside the base 10.

Adjacent to the proximal end part 35*a* of each coil terminal 35, a pin part 35*c* is formed to extending vertically upward. The pin part 35*c* is adapted to be disposed adjacent to the recess 25*b* of the terminal holder 25 and functions as a stopper when inserting the coil terminal 35 into the recess 25*b*.

Although not shown, the respective wire-ends of the coil 31 are entangled on and thus connected to the pin parts 35*c* of the respective-coil terminals 35. In the substantially right half of the terminal holder 25, four projections 25*c* are provided at the top surface of the terminal holder 25, and the lead lines of the wire of the coil 31, the ends of which are connected to the coil terminals 35, are respectively hooked or wound on the projections 25*c*. In the configuration wherein the lead lines of the wire of the coil 31 are hooked on the projections 25*c*, it is possible to suitably lay the lead lines extending from the coil 31 near the front-side flange 22 of the bobbin 20.

The distal end part 35*b* of each coil terminal 35 includes a flat end portion 35*d* having a shape bulging outward and adapted to be press-fitted to a circuit board (not shown). The flat end portion 35*d* is provided with a center through opening 35*e*. The flat end portion 35*d* has a lateral dimension slightly larger than that of a connection hole formed in the circuit board. When the flat end portion 35*d* is pushed into the connection hole, the flat end portion 35*d* is deformed so as to shrink the through opening 35*e*, and therefore is fitted in close contact with the inner wall of the connection hole.

The provision of the flat end portion 35*d* facilitates the mounting of the electromagnetic relay 1 on a circuit or control board since no soldering connections are required. Further, the electromagnetic relay 1 is directly mounted on the control board in this configuration, so that a required space can be saved in comparison with a configuration using a harness, etc. for connection of the relay to the board.

The base 10 is further provided in the shallow bottom area 17 with two through-holes 17*b*, 17*c* disposed to be aligned with the through-holes 17*a* into which four coil terminals 35 are inserted (FIG. 3). The electromagnetic relay 1 further includes a pair of signal terminals 65, 75 respectively connected to the busbar terminal members 60, 70, the signal terminals 65, 75 being inserted into the through-holes 17*b*, 17*c*.

The signal terminals 65, 75 include flat proximal end parts 65*a*, 75*a* adapted to horizontally extend, and flat distal end parts 65*b*, 75*b* joined to the proximal end parts 65*a*, 75*a* through downward right-angled bends, respectively. The distal end parts 65*b*, 75*b* are adapted to penetrate through the through-holes 17*b*, 17*c* formed in the base 10 and project outside the base 10. The proximal end parts 65*a*, 75*a* of the signal terminals 65, 75 are attached to signal-terminal engagement parts 61*e*, 71*e* formed on the busbar terminal members 60, 70 at the top edges of the plate portions 61, 71, respectively. The signal-terminal engagement parts 61*e*, 71*e* are provided with recesses in which the proximal end parts 65*a*, 75*a* are engaged. The distal end parts 65*b*, 75*b* of the signal terminals 65, 75 include, in the same way as the coil terminals 35, flat end portions 65*d*, 75*d*, respectively. The flat end portions 65*d*, 75*d* are provided with center through openings 65*e*, 75*e*, respectively, and have lateral dimensions slightly larger than those of connection holes formed in the circuit board (not shown).

The electromagnetic relay 1 further includes an actuator 80 adapted to be moved by a magnetic force generated by the electromagnet 30 and thereby acting to switch the busbar terminal members 60, 70 between a mutually conducting or current-carrying state and a mutually non-conducting or non-current-carrying state. The actuator 80 is made of a molded plastic and has an L-shape as seen in a plan view. The actuator 80 is pivotally arranged relative to the electromagnet 30 and having a pivot axis 81*a*. More specifically, the actuator 80 includes a generally L-shaped body as a cross-sectional shape perpendicular to the pivot axis 81*a*, and is provided with a vertically extending shaft 81 defining the pivot axis 81*a* at the first end of the first arm of the L-shaped body. The shaft 81 is pivotally received or inserted in a bearing hole 18*a* (FIG. 3) formed in the base 10, and thereby the actuator 80 can pivot about the shaft 81.

Figure 6:
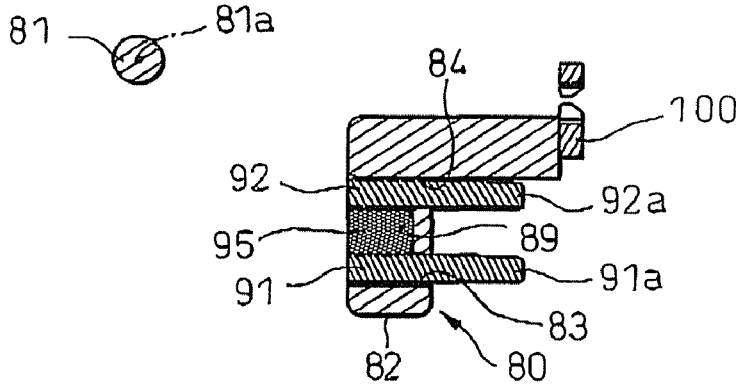
FIG. 6 is a sectional view showing an actuator of the electromagnetic relay of FIG. 1.

The electromagnetic relay 1 further includes an armature 90 driven by the electromagnet 30. The armature 90 is attached to the actuator 80 at the second end 82 of the L-shaped body of the actuator 80 opposite to the first end on which the shaft 81 is formed. The armature 90 includes a pair of electrically-conductive iron plate elements 91, 92. The plate elements 91, 92 are respectively fitted in and held by through-holes 83, 84 formed at the second end 82 of the actuator 80, and thus are arranged to extend parallel to each other and vertically in the base 10. As shown in the horizontal cross-sectional view of the actuator 80 in FIG. 6, the plate elements 91, 92 include projecting parts 91*a*, 92*a* adapted to be inserted into the through-holes 83, 84 from one side of the second end 82 of the actuator 80 facing the shaft 81 and to project from another side of the second end 82 opposite to the shaft 81. The actuator 80 is also provided with an extension 85 extending horizontally from the second end 82 so as to cover the top edges of the projecting parts 91*a*, 92*a*. The plate elements 91, 92 are also provides at the ends opposite to the projecting parts 91*a*, 92*a* with enlarged parts 91*b*, 92*b* extending in a height direction. The enlarged parts 91*b*, 92*b* are fitted in enlarged portions (not shown) of the through-holes 83, 84 of the actuator 80, whereby the plate elements 91, 92 are firmly fixed on the actuator 80.

The permanent magnet 95 is held between the plate elements 91, 92 adjacent to the enlarged parts 91*b*, 92*b*, and is retained to be fitted in a groove 89 (FIG. 6) formed on the side of the second end 82 of the actuator 80 facing the shaft 81. The plate elements 91, 92 are respectively connected to the poles of the permanent magnet 95, so as to form a magnetic flux path. Therefore, a certain magnetic field is constantly formed between the projecting parts 91*a*, 92*a* of the plate elements 91, 92.

Figure 7B:
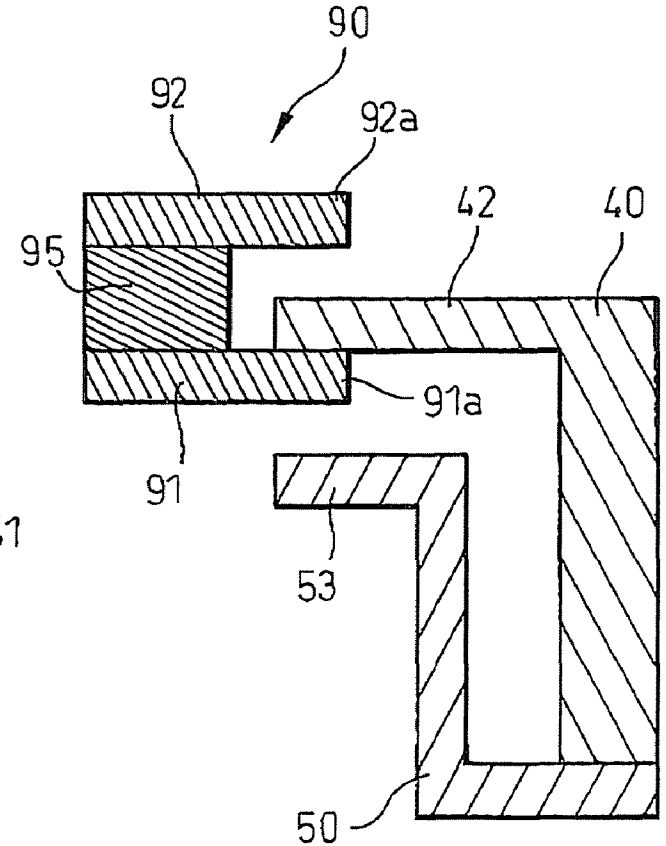
FIGS. 7A and 7B are sectional views showing the operating mode of the electromagnet of the electromagnetic relay of FIG. 1.
Figure 7A:
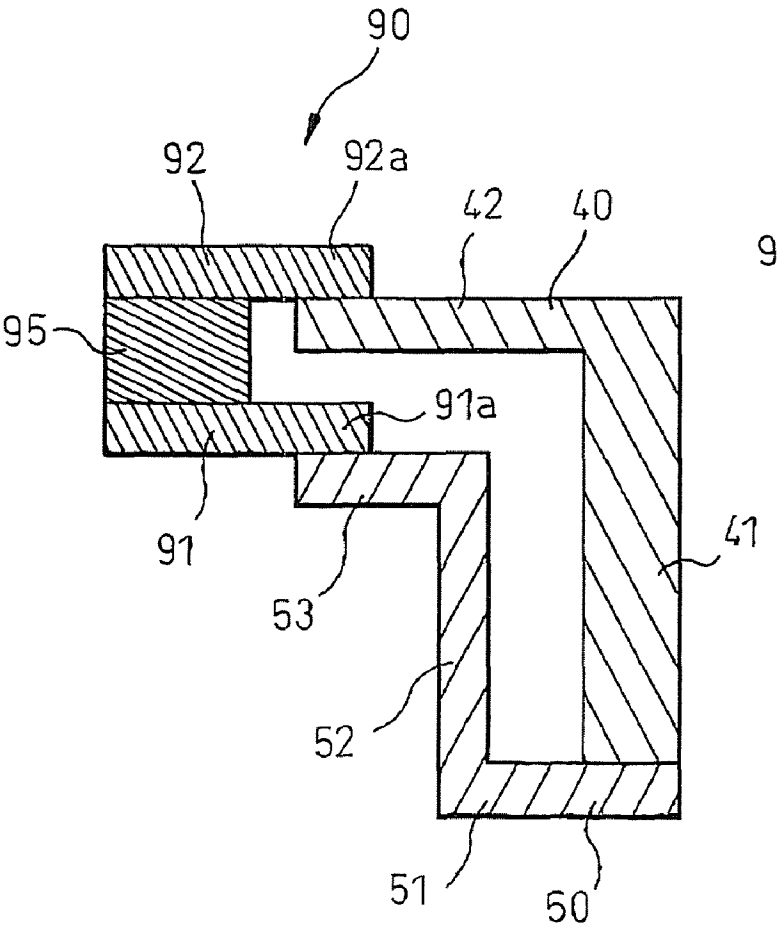

FIGS. 7A and 7B are cross-sectional views for explaining the positional relationship between the armature 90, the iron core 40 and the yoke 50, in which the actuator 80, coil 31, etc., are not shown for simplification. Further, in FIGS. 7A and 7B, the armature 90 is illustrated as to move in parallel, but the actuator 80 actually pivots about the pivot axis 81*a* (FIG. 6) in operation, and thus the armature 90 also actually pivots between the states shown in FIGS. 7A and 7B.

As shown in FIGS. 7A and 7B, the armature 90 is arranged so that a part of the projecting part 91*a* of the plate element 91 is shiftably located in the space between the left end of the plate part 42 of the iron core 40 and the distal-end plate part 53 of the yoke 50, and thus the pair of plate elements 91, 92 form a magnetic flux path-together with the iron core 40 and the yoke 50. Therefore, the magnetic field generated by the permanent magnet 95 between the projecting parts 91*a*, 92*a* of the plate elements 91, 92 of the armature 90 cooperates with the magnetic field generated by the coil 31 between the plate part 42 of the iron core 40 and distal-end plate part 53 of the yoke 50, so as to generate a magnetic force applied to the armature 90. As a result, a force is applied to the actuator 80 through the armature 90, which makes the actuator 80 pivot about the pivot axis 81*a*. The direction of the magnetic force applied to the armature 90 can be made either up or down as seen in FIGS. 7A and 7B, by changing the direction of the magnetic field generated by the coil 31, i.e., the direction of the current supplied to the coil 31, with respect to the direction of the magnetic field generated in the armature 90 by the permanent magnet 95.

When a magnetic force is applied to the armature 90 in a downward direction in FIGS. 7A and 7B, the armature 90 is moved by the magnetic force to a position where the projecting part 91*a* of the plate element 91 abuts against the distal-end plate part 53 of the yoke 50 and the projecting part 92*a* of the plate element 92 abuts against the plate part 42 of the iron core 40 (FIG. 7A). At the same time, the actuator 80 pivots in accordance with the movement of the armature 90 to a position corresponding to the illustrated position of the armature 90. At this position, the projecting parts 91*a*, 92*a* of the armature 90 are also subjected to a magnetic force due to the permanent magnet 95, which makes the projecting parts 91*a*, 92*a* attracted to the distal-end plate part 53 of the yoke 50 and the plate part 42 of the iron core. Therefore, once the armature 90 is moved to the position shown in FIG. 7A due to the energization of the coil 31, the armature 90 is held at the position shown in FIG. 7A even when the energization of the coil 31 is terminated.

When a magnetic force is applied to the armature 90 in an upward direction in FIGS. 7A and 7B, the armature 90 is moved by the magnetic force to a position where the projecting part 91*a* of the plate element 91 abuts against the plate part 42 of the iron core 41 (FIG. 7B). At the same time, the actuator 80 pivots in accordance with the movement of the armature 90 to a position corresponding to the illustrated position of the armature 90. In the same way as a situation shown in FIG. 7A, once the armature 90 is moved to the position shown in FIG. 7B due to the energization of the coil 31, the armature 90 is held at the position shown in FIG. 7B even when the energization of the coil 31 is terminated.

The electromagnetic relay 1 further includes a card 100 functioning to transmit the motion of the actuator 80 to the movable contacts 69*a*, 69*b* carried on the movable spring member 64. The card 100 is provided with three projections 101, 102, 103, and is securely attached to the actuator 80 with the projections 101-103 being respectively fitted in three recesses 86, 87, 88 formed on a side of the second arm of the L-shaped body of the actuator 80, from which the projecting parts 91*a*, 92*a* of the armature 90 project, at positions between the corner of the L-shaped body and the extension 85.

The card 100 is provided at the top end thereof with a horizontally extending top bar 105. The projections 102, 103 fitted to the actuator 80 are formed at the opposite ends of the top bar 105. More specifically, the projections 102, 103 are formed by bending the opposite end portions of the top bar 105 at right angles to the remaining center portion of the top bar 105.

The card 100 is also provided with a pair of vertical pieces 106, 107 extending downward from the top bar 105. The projection 101 fitted to the actuator 80 is formed at the bottom end of the vertical piece 106. More specifically, the projection 101 is formed by bending the bottom end portion of the vertical piece 106 at right angles to the remaining upper portion of the vertical piece 106.

Although not shown clearly, the movable spring member 64 is held between the mutually opposed surfaces of the vertical pieces 106, 107 at an intermediate portion of the movable spring member 64 between the rivets 67*a*, 67*b* and the movable contacts 69*a*, 69*b*. The mutually opposed surfaces of the vertical pieces 106, 107 are provided with protrusions, and the distance between one protrusion of the vertical piece 106 and one protrusion of the vertical piece 107 in a horizontal direction is slightly less than the thickness of the movable spring member 64. Thus, the movable spring member 64 can be stably and firmly held between the vertical pieces 106, 107. In this manner, the movable spring member 64 is engaged with the actuator 80 at a point defined in the second arm of the L-shaped body near the armature 90.

In the state where the card 100 attached to the actuator 80 holds the movable spring member 64 between the vertical pieces 106, 107, the movable spring member 64 can be shifted in accordance with the pivoting motion of the actuator 8*b* caused by the movement of the armature 90. Due to the shift of the movable spring member 64, the movable contacts 69*a*, 69*b* attached to the movable spring member 64 are also shifted. As a result, when the armature 90 is located at a position shown in FIG. 7A, the movable contacts 69*a*, 69*b* respectively contact with the fixed contacts 73*a*, 73*b*, and the busbar terminal members 60, 70 are thereby held in a mutually conducting state. On the other hand, when the armature 90 is located at the position shown in FIG. 7B, the movable contacts 69*a*, 69*b* are separated respectively from the fixed contacts 73*a*, 73*b*, and the busbar terminal members 60, 70 are thereby held in a mutually non-conducting state.

In the electromagnetic relay 1 of the illustrated embodiment explained above, the actuator 80 is configured as a pivotable member having a generally L-shaped body as a cross-sectional shape perpendicular to the pivot axis 81*a* defined by the shaft 81, the pivot axis 81*a* being positioned at the first end of the L-shaped body, and the card 100 (or the point of engagement with the movable spring member 64) is positioned on the second arm near the second end of the L-shaped body opposite to the pivot axis 81*a*. According to this configuration, it is possible to ensure a relatively long distance between the card 100 and the pivot axis 81*a* (i.e., a relatively long pivoting radius of the card 100) by efficiently using the given dimensions of the actuator 80 to a maximum extent. Therefore, it is possible to ensure the large amount of movement of the card 100, while preventing the dimensions and pivoting angle of the actuator 80 from being increased.

In this connection, in order to stably and reliably interrupt the current between the busbar terminal members 60, 70, it is required to separate the movable contacts 69*a*, 69*b* by a sufficient distance from the fixed contacts 73*a*, 73*b*; in particular, a relatively large distance of separation is desirable for a large current application, and therefore, it is required to ensure a sufficient amount of movement of the card 100.

According to the configuration of the electromagnetic relay 1 of the illustrated embodiment, the dimensions and pivoting angle of the actuator 80, required for ensuring the sufficient amount of movement of the card 100, can be effectively suppressed. Therefore, the space required for pivotally disposing the actuator 80 inside the base 10 can be reduced, which contributes to a reduction in the dimensions of the electromagnetic relay 1.

Further, the armature 90 is positioned at the second end of the L-shaped body of the actuator 80 opposite to the pivot axis 81*a*, so that it is possible to ensure a relatively long distance between the armature 90 and the pivot axis 81*a* (i.e., a relatively long pivoting radius of the armature 90) by efficiently using the given dimensions of the actuator 80 to a maximum extent. In the configuration wherein the armature 90 is positioned away from the pivot axis 81*a* as far as possible, it is possible to decrease a force applied to the armature 90 to obtain a torque required to shift the actuator 80. Therefore, the dimensions of the coil 31, permanent magnet 95, etc., can be reduced, which contributes to a reduction in the dimensions of the electromagnetic relay 1. In particular, for a large current application, it is required to increase the cross-sectional area of the movable spring member 64, in order to reduce the electric resistance thereof for the purpose of the reduction of loss and heat generation, so that the required torque tends to become larger. Therefore, especially for the large current application, the configuration wherein the armature 90 is positioned far away from the pivot axis 81*a* makes the downsizing effect of the electromagnetic relay 1 more valid and beneficial.

In the illustrated polarized electromagnetic relay 1 including the permanent magnet 95 assembled in the armature 90, the magnetic force of the permanent magnet 95 can be used to shift the armature 90 and cooperate with the magnetic force generated by the electromagnet 30, and thus it is possible to increase a force required for shifting the armature 90. Therefore, the polarized electromagnetic relay 1 is particularly suitable for a large current application. In the polarized electromagnetic relay 1, it is preferable to ensure the sufficient amount of movement of the armature 90, in order to stably maintain the switched states as explained with reference to FIGS. 7A and 7B. Also, the configuration of the actuator 80 having the L-shaped body can ensure the sufficient amount of movement of the armature 90 and keep the dimensions and pivoting angle of the actuator 80 small, and thus is preferable.

Further, due to the polarized configuration, even when the coil 31 is not energized, the actuator 80 is held and attracted to the iron core 40 or the yoke 50 by the magnetic force of the permanent magnet 95. Therefore, in the polarized configuration, it is possible to ensure the stabilization of the actuator 80, in spite of the configuration wherein the actuator 80 is supported through the shaft 81 and thus having less support compared to, e.g., a conventional slide-type actuator.

In the electromagnetic relay 1 of the illustrated embodiment, various components are press-fitted to the base 10 and held at predetermined positions on the base 10. Therefore, it is not required to provide separate or exclusive members to retain the components on the base 10, which also contributes to a reduction in dimensions of the electromagnetic relay 1.

Further, in the illustrated embodiment, the flat braided wire 63 is connected in parallel with the movable spring member 64. For a large current application, in order to reduce loss and heat generation, it is required to decrease an electric resistance in a current pathway relating to the movable and fixed contacts 69*a*, 69*b*, 73*a*, 73*b*. The provision of the flat braided wire 63 makes it possible to reduce the cross-sectional area of the movable spring member 64 while preventing the electric resistance in the current pathway relating to the movable and fixed contacts 69*a*, 69*b*, 73*a*, 73*b* from increasing. As a result, also due to the flexibility of the flat braided wire 63, it is possible to reduce a force required to shift the movable spring member 64 and thus reduce the dimensions of the coil 31, permanent magnet 95, etc., which contributes to a reduction in dimensions of the electromagnetic relay 1.

As described above, according to the electromagnetic relay 1 of the illustrated embodiment, it is possible to facilitate the reduction in dimensions and weight in comparison with a conventional electromagnetic relay. More specifically, the typical or exemplary dimensions of a conventional polarized electromagnetic relay is 735,000 $mm^3$ and the typical or exemplary weight thereof is 200 g, while the dimensions and weight of the electromagnetic relay 1 could be reduced to about 53,000 $mm^3$ and 120 g, respectively.

The electromagnetic relay 1 of the illustrated embodiment may be variously changed or modified within the scope of the subject matters described in the appended claims, as follows.

In the illustrated embodiment, four coil terminals 35 are provided, the first pair of coil terminals 35 being used for allowing a current flow between the busbar terminal members 60, 70, and the second pair of coil terminals 35 being used for interrupting a current flow between the busbar terminal members 60, 70. However, the configuration of coil terminals may be modified depending on the configuration of a circuit energizing the electromagnetic relay 1. For example, if the circuit is configured to supply current signals in reverse directions for the conducting and non-conducting states of the busbar terminal members 60, 70, the electromagnetic relay 1 may include only a single pair of coil terminals 35.

In the illustrated embodiment, the signal terminals 65, 75 are connected respectively to the busbar terminal members 60, 70, so as to enable the electrical conduction state of the busbar terminal members 60, 70 (i.e., whether the busbar terminal members 60, 70 is in the mutually conducting state or not) to be monitored through the signal terminals 65, 75. However, if monitoring is not required, the signal terminals 65, 75 may be omitted. Alternatively, an external circuit for monitoring the electrical conduction state of the busbar terminal members 60, 70 may be connected to the connection parts 62, 72 of the busbar terminal members 60, 70.

Figure 8A:
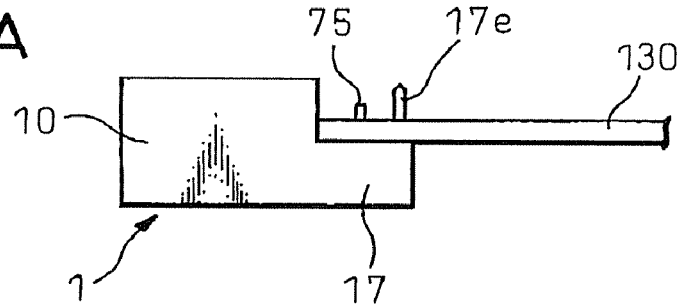
FIG. 8A is a side view showing the state of connection of the electromagnetic relay of FIG. 1 to a board.

In the illustrated embodiment, the base 10 is provided with the shallow bottom area 17, and the coil terminals 35 and signal terminals 65, 75 project from the bottom wall of the shallow bottom area 17. According to this configuration, as shown in FIG. 8A, it is possible to mount the electromagnetic relay 1 on a circuit board 130 in such a manner that the board 130 is positioned along the bottom wall of the shallow bottom area 17. Thus, it is possible to efficiently use an idle space beneath the shallow bottom area 17 for the placement of the board 130, and thus reduce a whole space to be occupied by a relay-board system.

In this connection, additional projections 17*d*, 17*e* may be formed on the outer surface of the bottom wall of the shallow bottom area 17 (FIG. 1), and the electromagnetic relay 1 may be mechanically fastened to the board 130 by inserting the projections 17*d*, 17*e* into holes (not shown) formed in the board 130. In this configuration, the distal end part of the coil terminals 35 and signal terminals 65, 75 are provided with flat end portions 35*d*, 65*d*, 75*d*, and thereby, together with the mechanical fastening of the board 130 and electromagnetic relay 1, the coil terminals 35 and signal-terminals 65, 75 can be conveniently connected electrically to the board 130. Alternatively, the coil terminals 35 and the signal terminals 65, 75 may be connected to the board 130 by soldering.

Figure 8B:
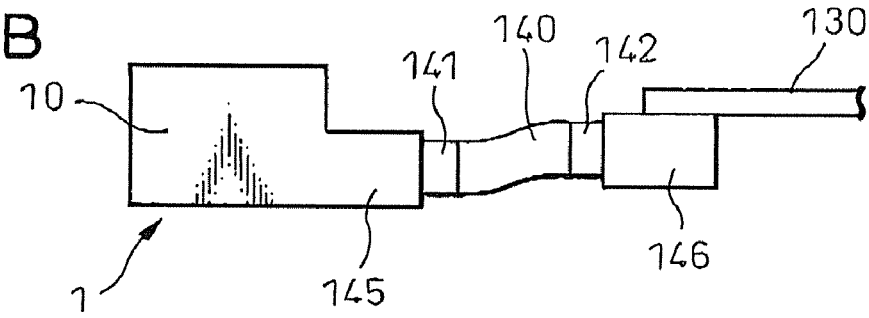
FIG. 8B is a side view showing a modification of the connection of FIG. 8A.

As a modification, as shown in FIG. 8B, it is also possible to use a harness 140 provided with connectors 141, 142 at the opposite ends thereof, so as to connect the electromagnetic relay 1 and the board 130. In this configuration, the electromagnetic relay 1 may be provided with a connector part 145 adapted to be connected to the connector 141 of the harness 140, and the board 130 may be provided with a connector 146 mounted thereon and adapted to be connected to the connector 142 of the harness 140.

In the illustrated embodiment, the card 100 is configured to hold the movable spring member 64 between the vertical pieces 106, 107. However, the mode of engagement of the card 100 with the movable spring member 64 may be variously modified, provided that the engagement surely makes the movable contacts 69*a*, 69*b* moved between a contact position and a separate position in relation to the fixed contacts 73*a*, 73*b*. For example, the movable spring member 64 may be configured to elastically urge the movable contacts 69*a*, 69*b* to contact the fixed contacts 73*a*, 73*b* in a state where no external force is applied from the card 100 to the movable spring member 64, and the card 100 may be configured to push the movable spring member 64 only when the movable contacts 69*a*, 69*b* are separated from the fixed contacts 73*a*, 73*b*. Alternatively, it is possible to provide the actuator 80 with a point of engagement with the movable spring member 64 as a unitary structure, and thus eliminate the card 100.

As described above, it is possible to provide an electromagnetic relay able to carry and interrupt a large current and also able to prevent the dimensions thereof from being increased.

While the invention has been described with reference to specific preferred embodiments, it will be understood by those skilled in the art that various changes and modifications may be made thereto without departing from the scope of the following claims.

The invention claimed is:

1. An electromagnetic relay comprising:

an electromagnet;

an armature driven by said electromagnet;

a movable spring member movably arranged relative to said electromagnet and carrying a movable contact;

a fixed member fixedly arranged relative to said electromagnet and carrying a fixed contact to be opposed to said movable contact;

an actuator pivotally arranged relative to said electromagnet and having a pivot axis, said actuator arranged between said armature and said movable spring member and pivoting under an operation of said electromagnet to make said movable contact brought into contact with or separated from said fixed contact;

wherein said actuator includes a generally L-shaped body as a cross-sectional shape perpendicular to said pivot axis, said pivot axis being defined at a first end of a first arm of said L-shaped body;

wherein said armature is attached to said actuator at a second end of a second arm of said L-shaped body opposite to said first end; and wherein said movable spring member is engaged with said actuator at a point defined in said second arm of said L-shaped body.

2. The electromagnetic relay of claim 1, further comprising a permanent magnet associated with said armature; wherein said electromagnet includes a bobbin, a coil wound on said bobbin, an iron core attached to said bobbin and having a first end and a second opposite end, and a yoke having a proximal end connected to said first end of said iron core and a distal end facing said second end of said iron core with a space defined outside said coil between said distal end and said second end; and wherein said armature includes a pair of electrically-conductive plate elements holding said permanent magnet therebetween and respectively connected to poles of said permanent magnet, a part of one of said plate elements being shiftably located in said space between said distal end of said yoke and said second end of said iron core.

3. The electromagnetic relay of claim 2, further comprising coil terminals connected to said coil of said electromagnet; wherein each of said coil terminals includes a flat end portion provided with a center through opening, said flat end portion being adapted to be press-fitted to a circuit board.

4. The electromagnetic relay of claim 1, further comprising a base on which said electromagnet, said movable spring member and said fixed member are supported through a press-fit configuration.

5. The electromagnetic relay of claim 4, wherein said actuator is provided with a shaft defining said pivot axis, said shaft being pivotally received in a bearing hole formed in said base.

6. The electromagnetic relay of claim 4, wherein said base is provided with a detent engagable with said electromagnet in a snap-fit manner.

7. The electromagnetic relay of claim 4, further comprising a pair of busbar terminal members including plate portions respectively press-fitted in grooves formed in said base; wherein said movable spring member is attached to a plate portion of a first busbar terminal member; and wherein said fixed member is provided as a plate portion of a second busbar terminal member.

8. The electromagnetic relay of claim 7, wherein said busbar terminal members and said electromagnet are press-fitted to said base by a press-fitting operation on a same side of said base; and wherein said second busbar terminal member is provided with a stopper engaging with said electromagnet.

9. The electromagnetic relay of claim 7, further comprising signal terminals connected respectively to said busbar terminal members.

10. The electromagnetic relay of claim 9, wherein each of said signal terminals includes a flat end portion provided with a center through opening, said flat end portion being adapted to be press-fitted to a circuit board.

11. The electromagnetic relay of claim 1, further comprising a flat braided wire electrically connected in parallel to said movable spring member.

* * * * *